United States Patent [19]

Schedele

[11] 4,185,163

[45] Jan. 22, 1980

[54] HOUSING ASSEMBLY FOR AN ELECTROMAGNETIC RELAY

[75] Inventor: Helmut Schedele, Hoegling, Fed. Rep. of Germany

[73] Assignee: Siemens Aktiengesellschaft, Berlin & Munich, Fed. Rep. of Germany

[21] Appl. No.: 797,340

[22] Filed: May 16, 1977

[30] Foreign Application Priority Data

May 18, 1976 [DE] Fed. Rep. of Germany ..... 2622133

[51] Int. Cl.[2] ..... H01H 9/04

[52] U.S. Cl. ..... 174/52 S; 335/202

[58] Field of Search ..... 335/202, 260, 278; 174/52 PE, 52 S; 220/217, 227, 228; 200/333

[56] References Cited

U.S. PATENT DOCUMENTS

| | | | |
|---|---|---|---|
| 634,677 | 10/1899 | Vaughn | 220/228 |
| 2,889,423 | 6/1959 | Yochum | 335/202 X |
| 3,046,452 | 7/1962 | Gellert | 174/52 PE X |
| 3,239,595 | 3/1966 | Reese et al. | 174/52 PE |
| 3,638,149 | 1/1972 | Bopp et al. | 335/202 X |
| 3,978,298 | 8/1976 | Fukuda et al. | 200/333 X |
| 4,039,984 | 8/1977 | DeLucia et al. | 335/202 X |

*Primary Examiner*—Bruce A. Reynolds
*Assistant Examiner*—D. A. Tone
*Attorney, Agent, or Firm*—Hill, Van Santen, Steadman, Chiara & Simpson

[57] ABSTRACT

A housing assembly for an electromagnetic relay with open ended box-like housing members telescopable one into the other to form a six sided housing. The inner housing is sealed to the outer housing by a sealing compound positioned at, at least the periphery of the bottom of the outer housing sealingly engaging the end edges of the open side of the inner housing.

1 Claim, 6 Drawing Figures

HOUSING ASSEMBLY FOR AN ELECTROMAGNETIC RELAY

BACKGROUND OF THE INVENTION

1. Field of the Invention

This invention relates to electric components and more particularly to a sealed housing for such components.

2. Prior Art

The invention pertains to electric components, and particularly to electromagnetic relays which utilize two part insulating housings. The two housing components interfit with one another in a boxed fashion to form a six sided housing.

Components having two part housings of this type are already known and are shown for example in German Offenlegungsschrift No. 2,016,903. That document describes a card relay having housing component halves which can be inserted into one another in a telescoping or inverted nestled fashion. However the side walls of the housing components only overlap to a slight degree. Although the housing functions as a dust protector, it is not protected against penetration of soldering elements and cleansing fluids to which the component will be exposed during assembly to the overall base, such as a conductor plate. In such assembly operations, both strong cleaning materials and solder will encounter the housing and either of those contaminants, including solder fumes and flux, can find entry to the housing damaging the interior component.

It would therefore be an advance in the art to provide a simple positive sealing system for such two component housing assemblies.

SUMMARY OF THE INVENTION

It is therefore the primary aim of this invention to design a two component housing for electric components in such a way that it is sealed in a simple manner during production and will thereafter substantially protect the functioning electronic elements interior of the housing. Such sealing should be capable of withstanding penetration both from soldering and cleansing fluids and also from other undesired environmental influences, such as, for example, industrial atmospheres in which the overall electronic device may be utilized.

In accordance with the teachings of this invention, the above overall aim is achieved while using housing components which interlock with one another in a boxed or inverted nestled fashion by providing a housing wherein the peripheral edge of the open end of the inner housing component is spaced slightly from the interior bottom of the outer housing component with the space between the components filled with a sealing means.

A construction according to this invention will insure that large sealing surfaces will be formed between the housing halves. The added sealing means will further cause the peripheral edge of the inner housing component to adhere firmly to the outer housing component. Inasmuch as the sealing means is preferably in contact with the outer housing's bottom wall and the inner surface of the side walls, and thus is prevented from escape, an optimum, long life, low leakage rate seal will be achieved.

As hereinafter described, the seal means can be provided in a number of ways, including the submersion of the open end peripheral edge into a sealing compound covering the bottom of the outer housing. In a second, but related embodiment, the sealing means can make use of a so called fleece which has been saturated with sealing compound and which is positioned within the outer housing in contact with the bottom thereof and with the inside faces of the peripheral side walls with the open end edge of the inner housing component in contact therewith with the fleece surrounding that edge.

Electric terminal pins which are used to connect the components interior of the housing with the exterior and which therefor provide leads outward from the housing generally constitute a critical sealing problem in that they require the provision of special openings in the housing which must thereafter be resealed by additional measures. In a housing constructed according to the present invention, the terminal pins, in one embodiment, can be injection molded into one of the housing components in such a manner that no open holes exist thereby eliminating sealing of such holes by subsequent measures. However, because injection molding of the terminals is not possible in all constructions and, further, necessitates a relatively high cost injection mold, this invention teaches a second method of sealing the pins. In the second embodiment, the electric terminal pins are inserted between the side walls of the two housing components which overlap one another. Because the open end periphery of the inner housing component is completely surrounded by the sealing compound, the terminal pins, which have been inserted between the housing side walls, and bent inwardly around the open end peripheral edge of the inner housing, will be also sealed and set in place by the sealing compound.

In all of the embodiments, the sealing compound is preferably a hardenable compound. During the hardening process associated with the sealing compound, the two housing components can either be pressed together manually, or by machinery, or they can be held in contact with one another by means of integral locking elements provided within the construction of the housing components. In order to allow ease of assemblage of the two housing components together, one of them is preferably provided with an opening to allow the escape of entrapped air during the telescoping of the housing components together. When the sealing compound has hardened after assembly, the small air opening can be closed by using a suitable casting resin or the like.

The composition of the sealing compound should be chosen such that no evaporation will result from the hardening thereof which evaporation could have an adverse effect upon the electric elements, particularly contacts, which are positioned interior of the housing. It is believed that those familiar with the art of such compounds can choose from among the known existing compounds to provide a finished component having the desired sealed character. For example, hardenable epoxy or resin compounds may be utilized.

Further, in an advantageous furthering of this invention, the sealing compound, which is used primarily to seal the overlapped edges of the housing components can also be used to fix the interior electric components in place within the housing. Thus the components to be protected, for example, a relay coil or associated yoke, can be set in place within the housing by the same operation which seals the housing.

It is therefore an object of this invention to provide a sealed electronic component utilizing a two part inverted nestled housing.

It is a more particular object of this invention to provide an electric component housing having two inverted open ended nestled box-like housing halves with the inner housing half having its open end sealed in position adjacent the bottom wall of the outer housing half by means of sealing compound which spaces the open end peripheral edge of the inner housing half from the bottom wall of the outer housing half with the space being filled with the sealant which is in contact with the inner surface of the peripheral walls of the outer housing and the bottom wall of the outer housing thereby preventing any leakage path from the interior of the housing to the exterior of the housing between the overlapped side walls of the housing halves, irrespective of the fact that electric leads, such as terminal pins, may be positioned between the overlapped side walls.

Other objects, features and advantages of the invention will be readily apparent from the following description of a preferred embodiment thereof, taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
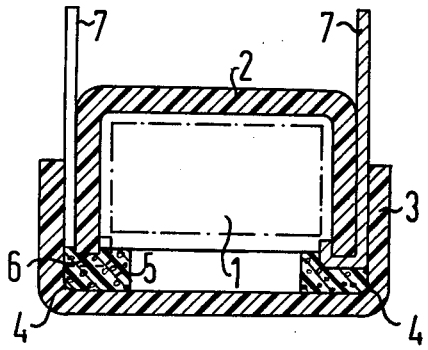
FIG. 1 is a sectional view of an electric component sealed in accordance with this invention employing a sealant saturated fleece.

FIG. 1 is a cross-sectional view illustrating an electric component 1 received in a housing constructed of two boxed housing components 2 and 3. The relationship of the housing components is herein referred to as inverted, telescoped or nestled relation with each of the housing halves consisting of a five sided open ended box-like member with the inner housing member being smaller than the outer housing member so as to telescope thereinto.

The two housing components are positioned one on top of the other in such a way that a large sealing surface is formed between their side walls which overlap. On the periphery 4 of the bottom wall of the outer housing, and in engagement with the bottom wall and with the inner surfaces of the side walls, a sealing substance 5 is positioned. The sealing substance 5 is preferably such as to have a high capillary suction force, such as, for example, a fleece or an elastic open cell foam which has been saturated with a dilute, hardenable filling compound.

The open end peripheral edge of the inner housing 2 is submerged into the sealing substance 5 in the outer housing 3. The sealing substance 5 thus completely seals the inter-space between the two housing components 2 and 3 by contacting both the bottom wall and inner surfaces of the side walls of the outer housing 3 and the peripheral open end edge 6 of the inner housing 2.

When the sealing compound in the fleece has hardened, the individual components of the housing will be firmly joined to one another. During the hardening process, it is either necessary to press the two components 2 and 3 together, or an additional lock means may be provided therebetween which will effectively hold the units together in contact with the sealing substance 5.

As illustrated, terminal pins 7 may extend between the overlapped housing half side walls with the terminal pins bending around the peripheral open end edge 5. These terminal pins, although spaced from one another providing gaps therebetween, will both be sealed and fixed in place by the same sealing substance 5 which seals the two housing halves together.

Figure 2:
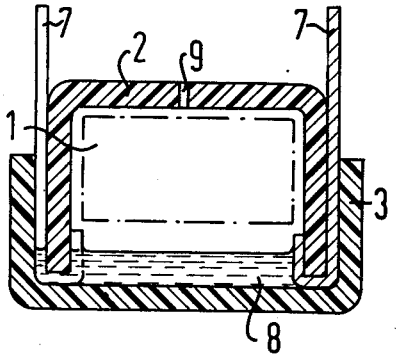
FIG. 2 is a view similar to FIG. 1 illustrating the use of a flowable sealing compound.

FIG. 2 illustrates substantially the same construction as FIG. 1 including an electric component 1 having two interlocking housing components 2 and 3 nestled together. In FIG. 2, however, sealing is accomplished by means other than the absorbent sealing substance 5 of FIG. 1. In place of that substance, a coarsely dosed quantity of a sealing compound 8 is poured into the outer (lower) housing half 3 and thereafter the upper (inner) housing half 2, having the electric component 1 fixed therein, is insertd into the housing half 3. This will produce a syphon-like seal. When the two housing halves are brought together, air can escape unobstructed through a small opening 9 in the closed end wall of the housing half 2. The opening 9 can be thereafter closed with a suitable casting resin when the sealing compound 8 has had an opportunity to harden.

Figure 3:
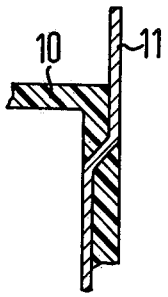
FIG. 3 is a fragmentary enlarged cross-section of a side wall of one of the housing halves injection molded with a terminal pin extending therethrough.
Figure 4:
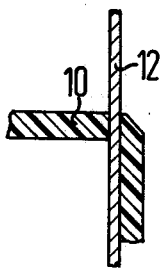
FIG. 4 is a view similar to FIG. 3 illustrating another manner in which the terminal pin may be injection molded.

Once again, in FIG. 2, as was the case in FIG. 1, terminal pins 7 may be provided between the overlapped walls of the housing halves with the pins being effectively secured in place and sealed by the same sealing compound 8 which seals the housing halves.

Where it is desired to not have the terminal pins 7, or all of such pins, extend between the overlapped housing walls, they may be molded in place. This is preferably done by injection molding at the time of formation of the housing half. Embodiments of this type are shown in FIGS. 3 and 4 in which a terminal pin 11 or 12 has been injected molded into the wall of a housing component 10. Because it is desirable to form the wall of the housing component as thick as possible, while maintaining given outer dimensions, the pin 11 is preferably formed flush with the surfaces of the housing wall.

Figure 5:
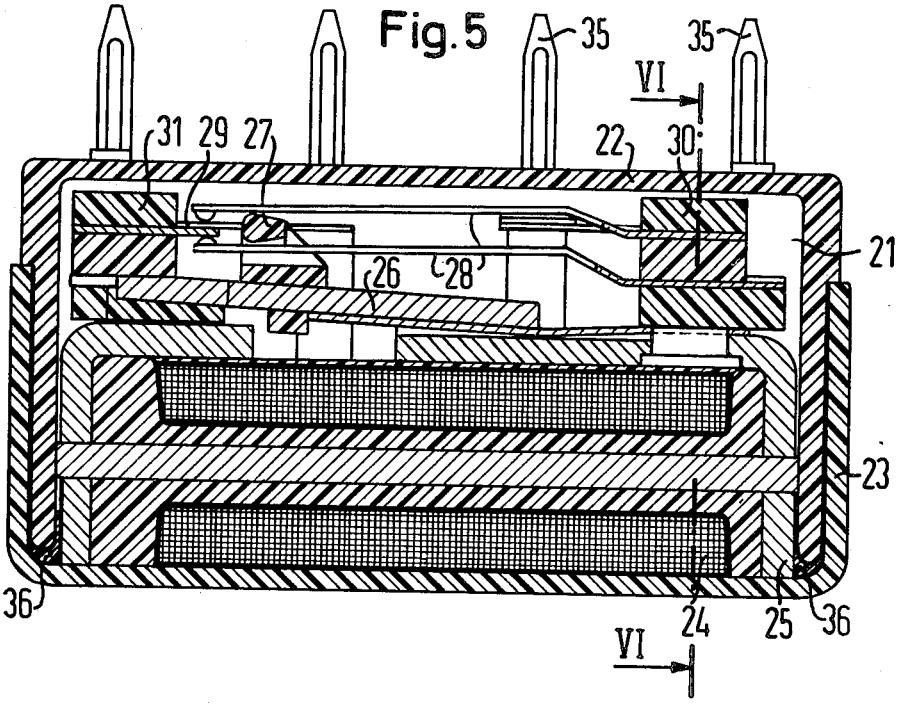
FIG. 5 is a longitudinal cross-section, on an enlarged scale, of a relay sealed according to this invention illustrating internal electric components.
Figure 6:
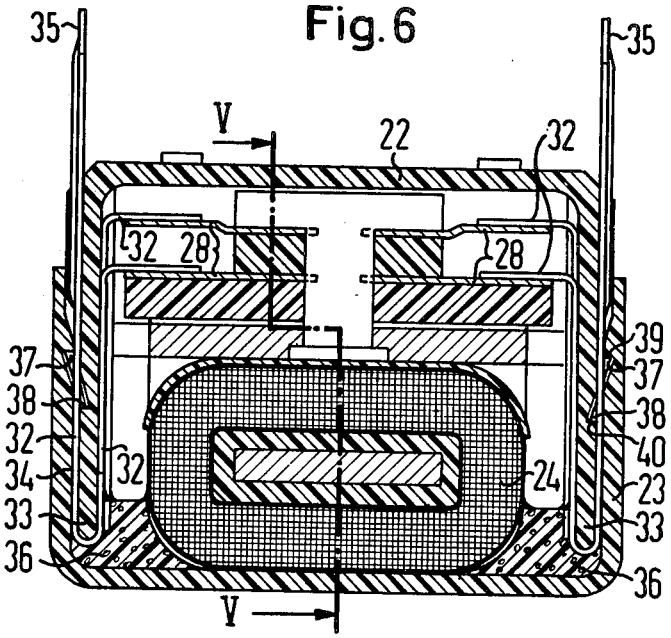
FIG. 6 is a cross-sectional view taken along the lines VI—VI of FIG. 5.

FIGS. 5 and 6 are sectional views of an electromagnetic relay assembly 12 received in a housing constructed according to the teachings of this invention. The housing includes two inverted nestled together housing halves 22 and 23. Received in the housing is a magnet system including a coil 24 and a multi-component yoke 25. An armature 26 actuates contact springs 28 through an intermediate actuating element 27. The contact springs, as well as a central contact 29, are secured on the magnet system by insulating blocks 30 and 31.

The electric contacts, 28 and 29, as well as the ends of the magnet coil wire (not shown) are connected by means such as welding to connecting lugs 32. The connecting lugs are bent around the open end peripheral edge 33 of the inner housing half 22 and extend outwardly in the area 34 between the overlapping housing halves 22 and 23 side walls to the exterior where they form soldering pins 35.

In the assembly of the relay illustrated, a contaminant free sealing compound 36 is poured into the outer, or lower, housing half 23. Thereafter the upper housing half 22, with the relay positioned therein is inserted into the half 23. The edge 33, together with the connecting lugs 32 which are bent around it, is submerged into the sealing compound 36 thus forming the desired, syphon-like seal, which upon hardening of the sealing compound will effectively join the housing halves while locking all of the components in place.

In order to maintain the two housing components in the correct position during hardening of the sealing compound in the area of the space 34 between the overlapping walls, the connecting lugs 32 may be provided with struck-out tang portions or lock elements 38 and 37 facing in opposite directions from one another which engage respectively in recesses or lock elements 39 and 40 in the housing components. Such tangs may also be provided in the housing halves. This method effectively locks the housing components in the desired position relative to one another with a gap existing between the bottom wall of the outer housing component and the peripheral edge 33 of the inner housing component. This gap is then sealed by the sealing compound 36.

Following hardening of the sealing compound 36, the coil 24 and yoke 25 will also be fixed in the housing due to their submersion in the sealing compound. Although FIGS. 5 and 6 are shown with the poured-in sealing compound of FIG. 2, it is of course possible to use the alternative absorbent sealing substance saturated with sealing compound shown in FIG. 1.

It can therefore be seen from the above that my invention provides an improved, sealed electric component housing utilizing two inverted nestled members with a gap between the interior bottom of the outer member and the peripheral open end edge of the inner member, the gap being closed by a sealing compound.

Although the teachings of my invention have herein been discussed with reference to specific theories and embodiments, it is to be understood that these are by way of illustration only and that others may wish to utilize my invention in different designs or applications.

I claim as my invention:

1. A housing for electric relays comprising first and second open ended tub-shaped housing components having peripheral side walls extending from a bottom wall, the second component being smaller than the first component and dimensioned to be received within the first component with terminal pins extending between the peripheral side walls of the components, the components being assembled together in inverted nestled relation with the peripheral side walls of the components overlapping and engaging the terminal pins with a space between a peripheral edge of the side wall of the second component and an inside surface of the bottom wall of the first component, said space being filled with a sealing means for effectively sealing the interior of the housing from the exterior with the peripheral edge of the second component being submerged in the sealing means, said nestled components defining an interior open area, an electric relay assembly being disposed in said open area and having moving parts, said moving parts being positioned above the bottom wall of the first component and the sealing means having a depth above the bottom wall less than the height of the position of the moving parts and less than the overlap height area of the peripheral side walls of the tub-shaped housing components, and said side walls and terminal pins having coacting lock elements which are effective in locking the housing components in the nestled relationship at a proper position with respect to one another with said space between the edge and bottom wall.

* * * * *